US011359467B2

(12) United States Patent
Bryant et al.

(10) Patent No.: US 11,359,467 B2
(45) Date of Patent: Jun. 14, 2022

(54) ROTATING ELECTRICAL CONNECTION FOR PERFORATING SYSTEMS

(71) Applicant: Halliburton Energy Services, Inc., Houston, TX (US)

(72) Inventors: Camille Anne Bryant, Cleburne, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 59 days.

(21) Appl. No.: 17/088,024

(22) Filed: Nov. 3, 2020

(65) Prior Publication Data

US 2022/0136373 A1 May 5, 2022

(51) Int. Cl.
*E21B 43/1185* (2006.01)
*E21B 17/02* (2006.01)

(52) U.S. Cl.
CPC ..... *E21B 43/1185* (2013.01); *E21B 17/028* (2013.01)

(58) Field of Classification Search
CPC .. E21B 43/1185; E21B 17/028; E21B 43/116; E21B 43/119; F42B 3/02; H01R 24/38
See application file for complete search history.

(56) References Cited

U.S. PATENT DOCUMENTS 3,307,642 A 3/1967 Smith
3,964,553 A 6/1976 Basham et al.
7,806,191 B2 * 10/2010 Braden ..... H01R 13/533 166/242.6
7,819,666 B2 10/2010 Sihler et al.
9,605,937 B2 3/2017 Eitschberger et al.
9,840,894 B2 12/2017 Jenne et al.
9,903,185 B2 2/2018 Ursi et al.
2005/0230098 A1 10/2005 Sand et al.
2006/0003846 A1 1/2006 Burger et al.
2012/0247769 A1 10/2012 Schacherer et al.
2015/0226044 A1 * 8/2015 Ursi ..... E21B 43/117 166/55
2016/0294139 A1 10/2016 Zacharko

FOREIGN PATENT DOCUMENTS

CN 204457680 7/2015
WO 2007082225 7/2007
WO 2015123429 8/2015

OTHER PUBLICATIONS

International Search Report and Written Opinion for Application No. PCT/US2021/017063, dated Jul. 8, 2021.
Corelab, Owens Oil Tools—Zero180 product line, Available at https://www.corelab.com/owen/gunsystems-zero180.
Adept, Product Line Velocity; Measuring the Flow, May 28, 2020.

* cited by examiner

*Primary Examiner* — Daniel P Stephenson
(74) *Attorney, Agent, or Firm* — John Wustenberg; C. Tumey Law Group PLLC

(57) ABSTRACT

Systems and methods of the present disclosure relate to rotatable electrical connectors for a downhole perforating tool. A downhole perforating tool comprises a first segment; a second adjacent segment that is rotatable, wherein the first and second segments are coaxially aligned or eccentrically aligned; and an electrical contact disposed between the first and second segments.

20 Claims, 4 Drawing Sheets

ROTATING ELECTRICAL CONNECTION FOR PERFORATING SYSTEMS

BACKGROUND

After drilling various sections of a wellbore that traverse a subterranean formation, individual metal tubulars may be secured together to form a casing string that is cemented within the wellbore. The casing string may provide a path for fluids to flow from producing subterranean intervals to the surface. To allow the fluids into the casing string, the casing string may be perforated.

Typically, the perforations may be created by detonating a series of charges within the casing string. Specifically, one or more charge carriers may be loaded with the charges. The charge carriers may then be secured within a tool string that is lowered into the casing string. Once the charge carriers are positioned at a desired depth, the charges may be detonated. Upon detonation, the charges may form jets that may cause perforations through the casing string, the cement, and a portion of the subterranean formation.

BRIEF DESCRIPTION OF THE DRAWINGS

These drawings illustrate certain aspects of some examples of the present disclosure and should not be used to limit or define the disclosure.

DETAILED DESCRIPTION

The present disclosure generally relates to techniques for grounding a detonator in an internally oriented wireline perforating system with minimum additional friction. In particular examples, an electrical conductor may include a carbon brush that may be attached to rotating internal segments of the perforating system. In some examples, the carbon brush may be attached to a rotatable charge tube and may contact and rub a stationary gun body or bulkhead to form an electrical circuit. This may produce minimal friction and not greatly increase any required torque needed to rotate portions of the perforating system. In certain examples, the carbon brush may lubricate a surface that the carbon brush contacts, thereby reducing required torque as it continues to rotate. This in turn may reduce the size of weights that may be required for adjusting a center of gravity for the perforating system during charge orientation, thereby allowing more space for perforating guns to be disposed on a single string.

In particular examples, a plurality of the electrical conductors may be arranged in a slip ring style configuration, rather than with wires or metal clips that may break. Each electrical conductor may include a segment such as a disc, thereby allowing for the plurality of the electrical conductors to be configured as a conductive disc assembly. The disc assembly may include different configurations to accommodate different electrical paths and/or components. Each disc may include an insulator and an embedded conductive surface that may electrically mate to an adjacent disc. An electrical contact or the carbon brush may be disposed in between the adjacent discs, thereby forming a conductive path that may connect to a primary internal component of the perforating system, such as a detonator. In particular examples, the discs may include printed circuit boards.

Figure 1:
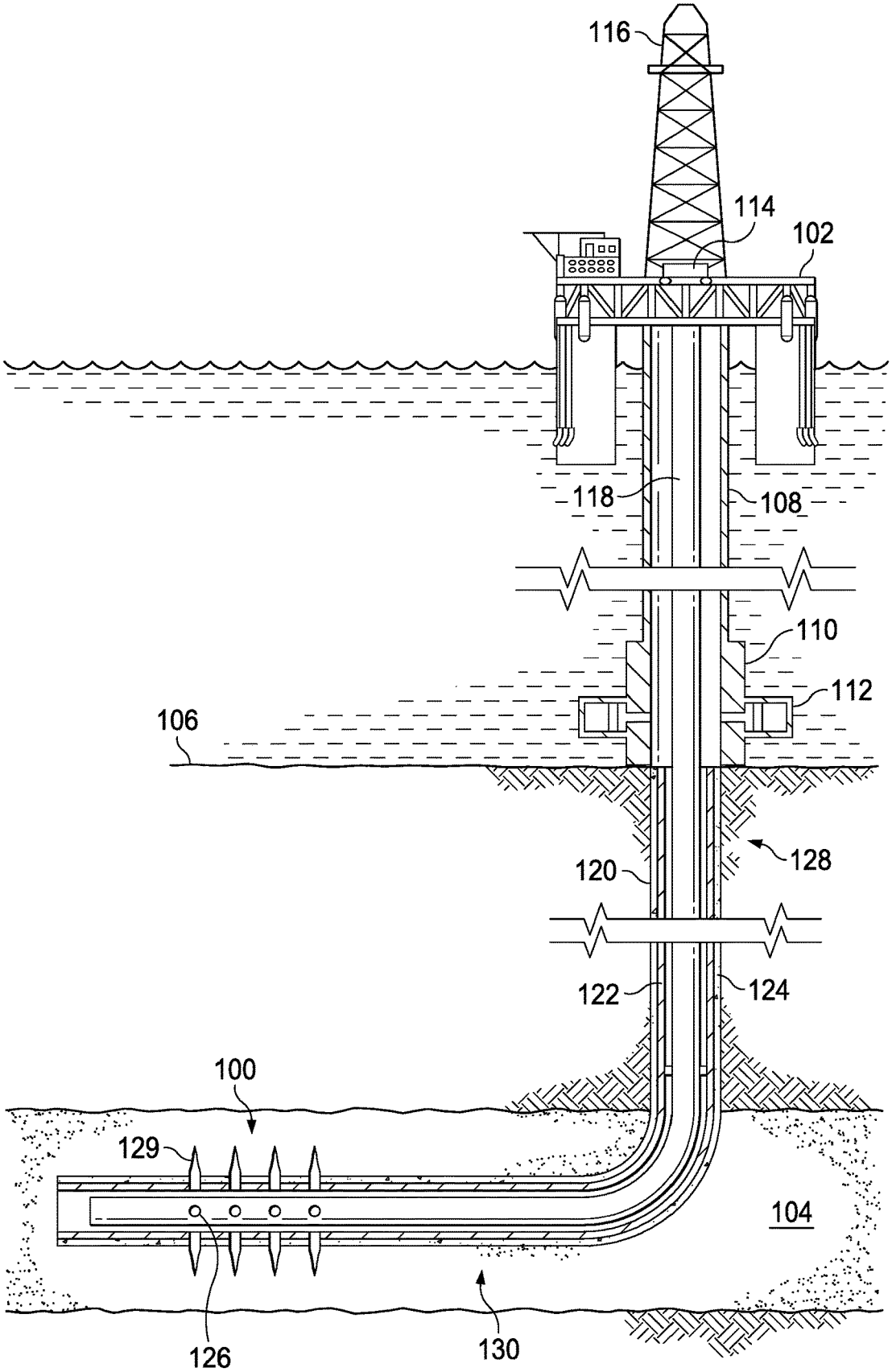
FIG. 1 illustrates an operating environment for a perforating tool, in accordance with examples of the present disclosure.

FIG. 1 illustrates an operating environment for a perforating tool 100, in accordance with examples of the present disclosure. A semi-submersible platform ("platform 102") may be centered over a submerged oil and gas formation 104 that may be located below a sea floor 106. A subsea conduit 108 may extend from the platform 102 to a wellhead installation 110 which may include subsea blow-out preventers 112. The platform 102 may include a hoisting apparatus 114 and a derrick 116 for raising and lowering pipe strings such as a work string 118 which may include the perforating tool 100. The work string 118 may also include a conveyance such as a wireline, slickline, coiled tubing, pipe, or downhole tractor, which may provide mechanical suspension, as well as electrical connectivity, for the perforating tool 100, for example. It should be understood that the configuration of the perforating tool 100 shown on FIG. 1 is merely illustrative and other configurations of the perforating tool 100 may be utilized with the present techniques. For example, although FIG. 1 depicts an offshore environment, systems and methods of the present disclosure may also be utilized onshore.

A wellbore 120 may extend through various earth strata including the formation 114. A casing string 122 may be cemented within the wellbore 120 by cement 124. The wellbore 120 may include an initial, generally vertical portion 128 and a lower, generally deviated portion 130 which is illustrated as being horizontal. It should be noted, however, by those skilled in the art that the perforating tool 100 may also be suited for use in other well configurations including, but not limited to, inclined wells, wells with restrictions, non-deviated wells, and/or multilateral wells, for example.

The perforating tool 100 may include various tools such as a plurality of perforating apparatuses or guns 126. To perforate the casing string 122, the perforating tool 100 may be lowered in the casing string 122 until the perforating guns 126 are properly positioned relative to the formation 104. Thereafter, in some examples, shaped charges (not shown) within the perforating guns 126 are detonated. Upon detonation, liners of the shaped charges may form a spaced series of perforations 129 extending outwardly through the casing string 122, the cement 124, and into the formation 104, thereby allowing fluid communication between the formation 104 and the wellbore 120.

Figure 2A:
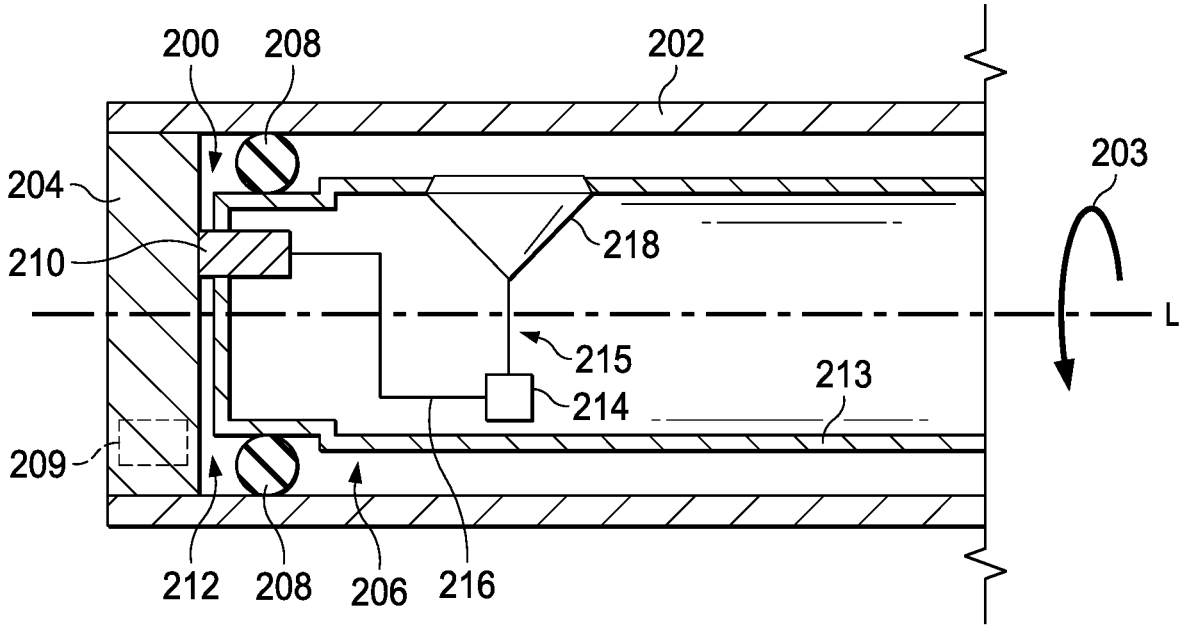
FIG. 2A illustrates a cross-sectional side view of an internal rotatable electrical connection of the perforating tool, in accordance with examples of the present disclosure.

FIG. 2A illustrates a cross-sectional side view of an internal rotatable electrical connection 200 of a perforating tool, in accordance with examples of the present disclosure. The connection 200 may be housed within a gun body 202 (e.g., a tubular or cylindrical hollow member) of the perforating tool 100 (e.g., shown on FIG. 1), and may be configured to rotate freely (e.g., 360° in a clockwise or counterclockwise direction) due to gravity, for example, as indicated by a directional arrow 203. The connection 200 may include a first segment 204 and a second segment 206. The second segment 206 may include a bearing(s) 208 to allow rotation around a longitudinal axis L (e.g., the axis of rotation) of the gun body 202. The second segment 206 may rotate relative to the first segment 204 that may be stationary. In some examples, the first segment 204 may be fixed to the gun body 202 via welds or threads, for example. In some examples, the first segment 204 may include a conductive surface 203 or a printed circuit board 209 that may be in communication with the conductive surface 203. The first segment 204 and the second segment 206 may be spaced apart and aligned coaxially (or eccentrically aligned) in an end-to-end configuration with a gap 212 disposed between the first segment 204 and the second segment 206. In some examples, the segments 204 and 206 may include discs. An electrical contact 210 such as copper or a carbon brush, may be disposed therebetween to bridge the gap 212 between the conductive surface 203 of the first segment 204 and the second segment 206, to provide electrical conductivity therethrough. The contact 210 may be positioned to contact the first segment 204 and the second segment 206, and may be rigidly coupled to the second segment 206, such that the electrical contact 210 rubs against the conductive surface 203 in a circular motion upon rotation of the second segment 206. As previously noted, the electrical contact 210 may include the carbon brush, which in some examples may be made of carbon powder and/or graphite powder, to lubricate contacted surfaces (e.g., the conductive surface 203 during rubbing or rotation.

In some examples, the second segment 206 may be disposed on an end of a charge tube 213 or include the charge tube 213. The second segment 206 may be concentrically positioned within the gun body 202 such that the second segment and the gun body 202 are coaxially aligned. The charge tube 213 may be a rotatable (e.g., 360°) tubular member extending lengthwise within the gun body 202. An outer diameter of the charge tube 213 and the second segment 206 may be slightly less than an inner diameter of the gun body 202 to allow rotation within the gun body 202. The charge tube 213 may include a detonator 214 operatively coupled via a detonation cord 215 to a shaped charged 218 disposed within the charge tube 213. In some examples, an electrical path 216 may extend from the first segment 204 to the detonator 214 via the electrical contact 210. The configuration as depicted in FIG. 2A may allow for conductivity through rotating segments that are arranged coaxially or end-to-end, for example.

Figure 2B:
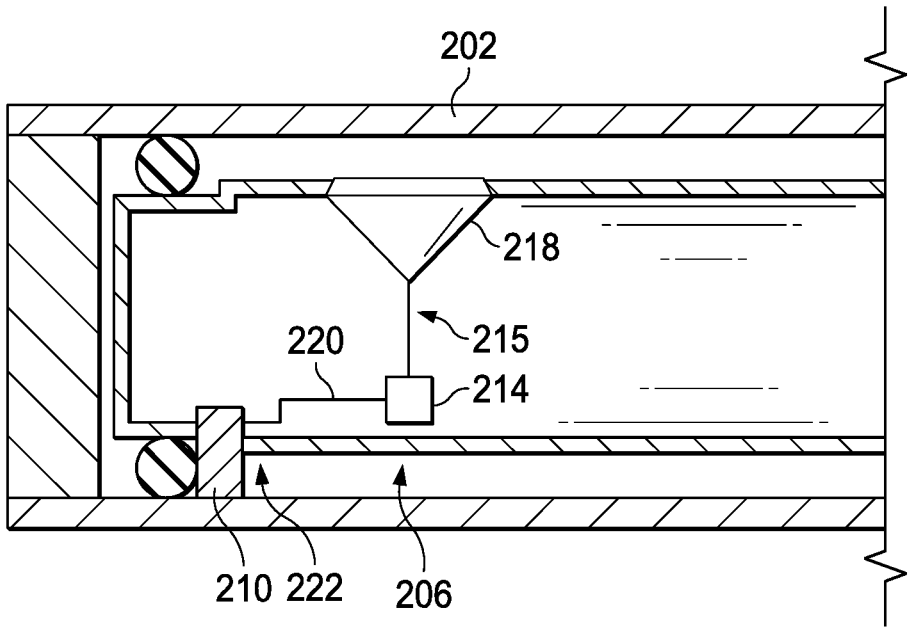
FIG. 2B illustrates an alternate configuration of an electrical contact, in accordance with examples of the present disclosure.

FIG. 2B illustrates an alternate configuration of the electrical contact 210, in accordance with examples of the present disclosure. As illustrated, the electrical contact 210 may be attached to a lateral portion of the second segment 206 to contact the gun body 202. In this configuration, the electrical contact 210 may bridge a laterally positioned gap 222 extending between the second segment 206 and the gun body 202. In some examples, the electrical contact 210 may provide for an electrical path 220 from the gun body 202 to the detonator 214 and to the shaped charge 218 via the detonation cord 215. The configuration as depicted in FIG. 2B may allow for conductivity through rotating segments that are arranged concentrically to allow conductivity in a radial direction, for example.

Figure 3A:
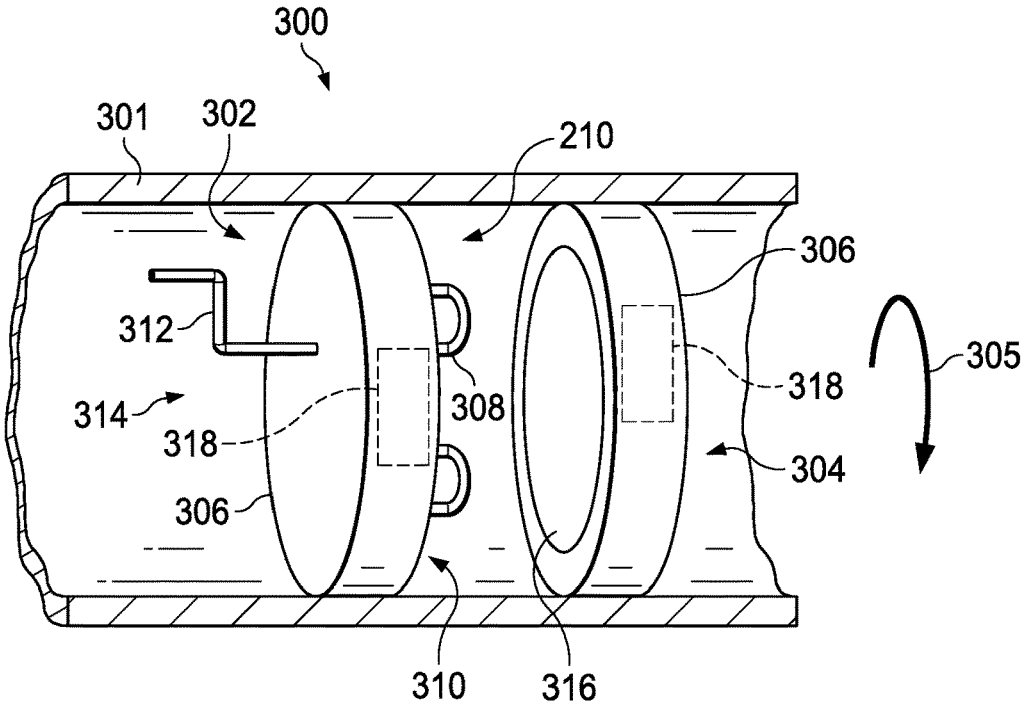
FIG. 3A illustrates a perspective side view of a conductive disc assembly disposed within a gun body of the perforating tool, in accordance with examples of the present disclosure.

FIG. 3A illustrates a perspective side view of a conductive disc assembly 300 that may be disposed within a gun body 301 of a perforating tool, in accordance with examples of the present disclosure. The disc assembly 300 may include a first disc 302 and an adjacent second rotatable disc 304. Both discs 302 and 304 may be coaxially aligned with one another. The first disc 302 may be stationary or fixed within the gun body 301, via welds or threads, for example. The second disc 304 may not be fixed to the gun body 301 and thus may be free to rotate 360° as indicated by a directional arrow 305, within the gun body 301. In certain examples, the second disc 304 may be attached to the charge tube 213 (shown on FIG. 2A) and may rotate due to gravity, during charge orientation (e.g., rotation of the charge tube 213 shown on FIG. 2A), as should be understood by one having skill in the art with the benefit of this disclosure. An outer diameter (OD) of each of the discs 302 and 304 may range from 4 centimeters (cm) to 23 cm, and a thickness may range from 3 millimeters (mm) to 30 mm, in some examples. The OD of each of the discs 302 and 304 may be less than an inner diameter of the gun body 301 to allow concentric placement of the discs within the gun body 301. The discs 302 and 304 may be configured in a stack extending within the gun body 301, for example. In certain examples, an outer surface of the disc 304 and an inner surface of the gun body 301 may be smooth to minimize friction therebetween, during rotation. Rotation may occur via the bearings 208, as shown on FIG. 2A, for example.

The first disc 302 may be a support disc and may include an electrical insulating material 306 surrounding at least one electrical contact 210 extending from the first disc 302. The electrical contact 210 may include at least one conductive arc 308. The first disc 302 may include a first surface 310 and a second opposite surface 314. A portion 312 of the electrical contact 210 may pass from the first surface 310 and through the first disc 302, to protrude from the second surface 314 of a second opposite side of the first disc 302. The portion 312 may contact another conductive component, in some examples.

The second disc 304 may also be a support disc including insulating material 306 that may surround an embedded inner conductive surface 316. In some examples, the surface 316 may have a diameter ranging from 3.5 cm to 22.5 cm. The surface 316 may face and be configured to contact and rub against the surface 310 to provide electrical conductivity, during rotation of the second disc 304. In particular examples, the discs 302 and 304 may include printed circuit boards 318. The configuration (e.g., the arcs 308 and the conductive surface 316) as depicted in FIG. 3A provides a low friction electrical connection that does not rely on the first and second segments begin perfectly concentric to maintain a constant signal.

Figure 3B:
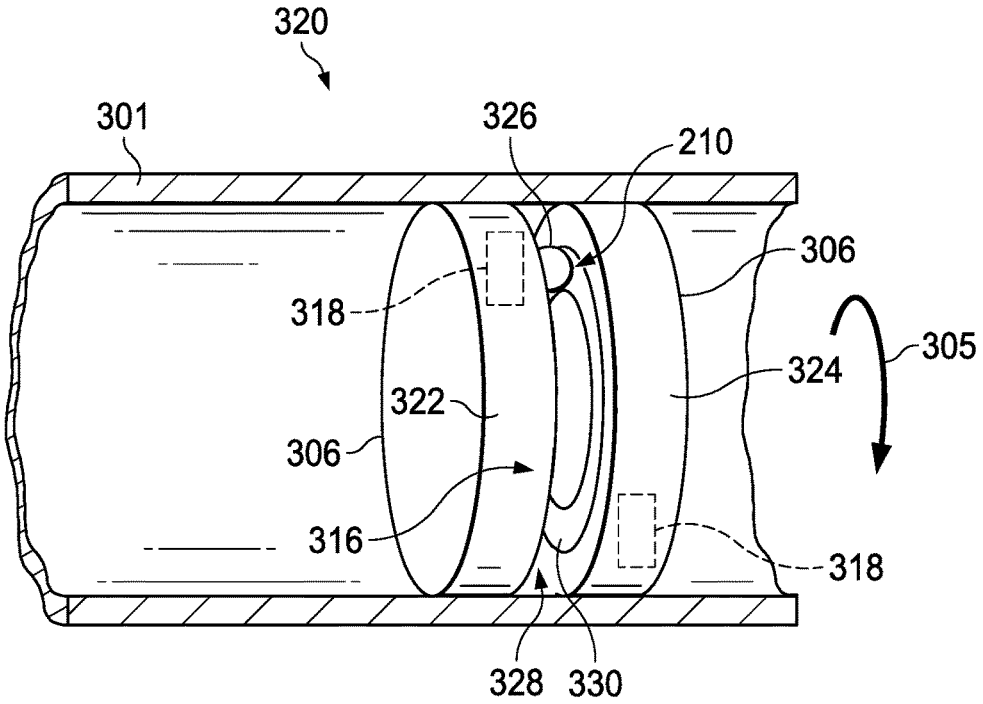
FIG. 3B illustrates a perspective side view of an alternate conductive disc assembly, in accordance with examples of the present disclosure.

FIG. 3B illustrates a perspective side view of a conductive disc assembly 320 that may be disposed within the gun body 301 of a perforating tool, in accordance with examples of the present disclosure. Similar to the disc assembly 300 of FIG. 3A, the disc assembly 320 may include a first disc 322 and an adjacent second rotatable disc 324. Both discs 322 and 324 may be coaxially aligned with one another and the second disc 304 may be free to rotate 360° as indicated by the directional arrow 305, within the gun body 301.

The first disc 322 may be a support disc including an electrical insulating material 306 surrounding at least one electrical contact 210 extending from the first disc 322. The electrical contact 210 may include a carbon brush 326. The first disc 322 may include a surface 328 that includes the carbon brush 326.

The second disc 324 may also be a support disc including insulating material 306 that may surround the embedded inner conductive surface 316 which may include a conductive ring 330. In some examples, the conductive ring 330 may have an inner diameter ranging from 3.25 cm to 22.25 cm, and an outer diameter ranging from 3.5 cm to 22.5 cm. The conductive ring 330 may be made of any suitable material such as copper, for example. The ring 330 may face and be configured to contact and rub against the carbon brush 326 to provide electrical conductivity therethrough, during rotation of the ring 330. The carbon brush 326 may be aligned with the ring 330 such that the carbon brush 326 maintains contact with the ring 330 during rotation of the ring 330. In particular examples, the discs 322 and 324 may include printed circuit boards 318.

Figure 4:
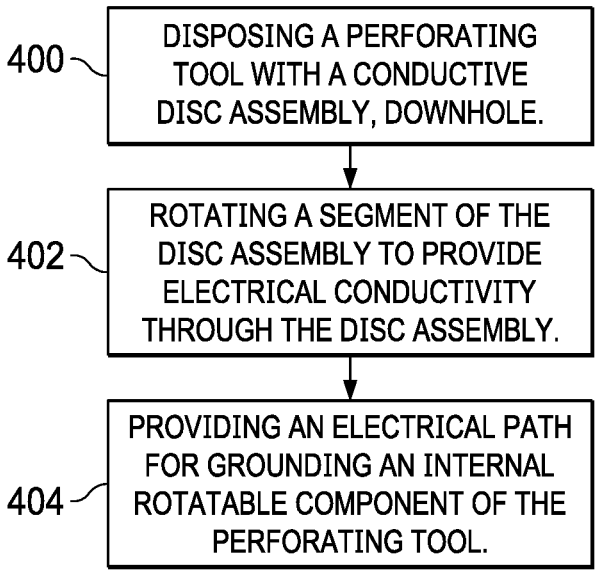
FIG. 4 illustrates an operative sequence for passing electricity through a rotating segment of a perforating tool, in accordance with examples of the present disclosure.

FIG. 4 illustrates an operative sequence for passing electricity such a ground current through a rotating segment of a perforating tool, in accordance with particular examples of the present disclosure. At step 400, the perforating tool 100 may be disposed downhole (e.g., shown on FIG. 1). The perforating tool 100 may include the disc assembly 300 and/or the disc assembly 320 as shown on FIGS. 3A and 3B, for example. At step 402, a segment (e.g., the segments 204 and 206 shown on FIG. 2A) such as a disc (e.g., discs 302, 302, 322, and 324 shown on FIGS. 3A and 3B) of the disc assembly may rotate and provide electrical conductivity therethrough. At step 404, the disc assembly may provide an electrical path for grounding an internal rotatable electrical component(s) of the perforating tool such as the detonator 214 of the charge tube 213 (e.g., shown on FIG. 2A) and/or a printed circuit board 318 (e.g., shown on FIGS. 3A and 3B).

Accordingly, the systems and methods of the present disclosure may allow for 360° rotatable electrical connections for downhole perforating tools. The systems and methods may include any of the various features disclosed herein, including one or more of the following statements.

Statement 1. A perforating tool comprising: a first segment; a second adjacent segment that is rotatable, wherein the first and second segments are coaxially aligned or eccentrically aligned; and an electrical contact disposed between the first and second segments.

Statement 2. The tool of the statement 1, wherein the electrical contact comprises a carbon brush.

Statement 3. The tool of any one of the preceding statements, wherein the second segment includes a detonator.

Statement 4. The tool of any one of the preceding statements, wherein the electrical contact is attached to the first segment.

Statement 5. The tool of any one of the preceding statements, wherein each of the first and segments includes a disc, wherein an axis of rotation extends longitudinally through the discs.

Statement 6. The tool of any one of the preceding statements, wherein the second segment includes a disc, the disc of the second segment including an embedded conductive surface.

Statement 7. The tool of any one of the preceding statements, wherein the embedded conductive surface includes a ring, wherein the electrical contact is aligned to maintain contact with the ring upon rotation of the second segment.

Statement 8. The tool of any one of the preceding statements, wherein the electrical contact comprises an arc or a carbon brush.

Statement 9. A downhole perforating system comprising: a gun body; an adjacent segment that is rotatable within the gun body, wherein the segment and the gun body are concentrically positioned; and an electrical contact disposed between the segment and the gun body.

Statement 10. The system of the statement 9, wherein segment is rotatable 360° relative to the gun body.

Statement 11. The system of the statement 9 or 10, wherein the segment comprises a shaped charge.

Statement 12. The system of any one of the statements 9-11, wherein the segment comprises a detonator.

Statement 13. The system of any one of the statements 9-12, wherein the electrical contact comprises a carbon brush.

Statement 14. The system of any one of the statements 9-13, wherein an axis of rotation of the segment extends in a direction of a longitudinal axis of the gun body.

Statement 15. The system of any one of the statements 9-14, wherein the segment comprises a charge tube, wherein the charge tube is configured to rotate during orientation of a shaped charge that is disposed within the charge tube.

Statement 16. A method for electrically connecting internal components of a perforating tool, the method comprising: disposing a perforating tool downhole, the perforating tool including a segment that is rotatable, wherein the segment is in electrical communication with an internal component of the perforating tool and is disposed within a gun body of the perforating tool.

Statement 17. The method of the statement 16, further comprising rotating the segment while maintaining electrical conductivity with the internal component, the internal component comprising a detonator, wherein an electrical contact is disposed between the detonator and the segment.

Statement 18. The method of the statement 16 or 17, further comprising rotating the segment while maintaining electrical conductivity with the internal component, the internal component comprising a printed circuit board, wherein an electrical contact is disposed between the printed circuit board and the segment.

Statement 19. The method of any one of the statements 16-18, further comprising rotating the segment while maintaining electrical conductivity between the gun body and the segment, wherein an electrical contact is disposed between the gun body and the segment.

Statement 20. The method of any one of the statements 16-19, further comprising lubricating a conductive surface with a carbon brush during rotation of the segment, the electrical contact comprising the carbon brush.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole perforating tool comprising:

a first segment;

a second adjacent segment that is rotatable, wherein the first and second segments are coaxially aligned or eccentrically aligned;

an electrical contact disposed between the first and second segments; and an insulating material disposed around the electrical contact.

2. The perforating tool of claim 1, wherein the electrical contact comprises a carbon brush.

3. The perforating tool of claim 1, wherein the second segment comprises a detonator.

4. The perforating tool of claim 1, wherein the electrical contact is attached to the first segment.

5. The perforating tool of claim 4, wherein each of the first and second segments comprises a disc, wherein an axis of rotation extends longitudinally through the discs.

6. The perforating tool of claim 5, wherein the second segment comprises a disc, the disc of the second segment including an embedded conductive surface.

7. The perforating tool of claim 6, wherein the embedded conductive surface comprises a ring, wherein the electrical contact is aligned to maintain contact with the ring upon rotation of the second segment.

8. The perforating tool of claim 7, wherein the electrical contact comprises an arc or a carbon brush.

9. A downhole perforating system comprising:

a gun body;

an adjacent segment that is rotatable within the gun body, wherein the segment and the gun body are concentrically positioned;

an electrical contact disposed between the segment and the gun body; and an insulating material disposed around the electrical contact.

10. The downhole perforating system of claim 9, wherein segment is rotatable 360° relative to the gun body.

11. The downhole perforating system of claim 9, wherein the segment comprises a shaped charge.

12. The downhole perforating system of claim 9, wherein the segment comprises a detonator.

13. The downhole perforating system of claim 9, wherein the electrical contact comprises a carbon brush.

14. The downhole perforating system of claim 9, wherein an axis of rotation of the segment extends in a direction of a longitudinal axis of the gun body.

15. The downhole perforating system of claim 9, wherein the segment comprises a charge tube, wherein the charge tube is configured to rotate during orientation of a shaped charge that is disposed within the charge tube.

16. A method for electrically connecting internal components of a perforating tool, the method comprising:

disposing a perforating tool downhole, the perforating tool including a segment that is rotatable, wherein the segment is in electrical communication with an internal component of the perforating tool via an electrical contact and is disposed within a gun body of the perforating tool, wherein an insulating material is disposed around the electrical contact.

17. The method of claim 16, further comprising rotating the segment while maintaining electrical conductivity with the internal component, the internal component comprising a detonator, wherein the electrical contact is disposed between the detonator and the segment.

18. The method of claim 16, further comprising rotating the segment while maintaining electrical conductivity with the internal component, the internal component comprising a printed circuit board, wherein the electrical contact is disposed between the printed circuit board and the segment.

19. The method of claim 16, further comprising rotating the segment while maintaining electrical conductivity between the gun body and the segment, wherein the electrical contact is disposed between the gun body and the segment.

20. The method of claim 16, further comprising lubricating a conductive surface with a carbon brush during rotation of the segment, the electrical contact comprising the carbon brush.

* * * * *